US011592219B2

(12) United States Patent
Jang et al.

(10) Patent No.: US 11,592,219 B2
(45) Date of Patent: Feb. 28, 2023

(54) METHOD OF CONTROLLING GAS HEAT-PUMP SYSTEM

(71) Applicant: LG ELECTRONICS INC., Seoul (KR)

(72) Inventors: Heejoong Jang, Seoul (KR); Hojong Jeong, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 247 days.

(21) Appl. No.: 17/130,561

(22) Filed: Dec. 22, 2020

(65) Prior Publication Data

US 2021/0190392 A1 Jun. 24, 2021

(30) Foreign Application Priority Data

Dec. 23, 2019 (KR) ..... 10-2019-0173203

(51) Int. Cl.
*F25B 27/00* (2006.01)
*F25B 30/02* (2006.01)
*F25B 49/02* (2006.01)

(52) U.S. Cl.
CPC ..... *F25B 27/00* (2013.01); *F25B 30/02* (2013.01); *F25B 49/025* (2013.01); *F25B 2313/0315* (2013.01); *F25B 2327/00* (2013.01)

(58) Field of Classification Search
CPC ..... F25B 27/00; F25B 30/02; F25B 49/025; F25B 2313/0315; F25B 2327/00; F25B 49/02; F02P 3/08; F02P 3/045
See application file for complete search history.

(56) References Cited

U.S. PATENT DOCUMENTS

2017/0089617 A1* 3/2017 Choi ..... F25B 13/00

FOREIGN PATENT DOCUMENTS

KR 10-1341533 1/2014

* cited by examiner

*Primary Examiner* — Elizabeth J Martin
(74) *Attorney, Agent, or Firm* — Ked & Associates, LLP

(57) ABSTRACT

Proposed is a method of controlling a gas heat-pump system, the system including an air conditioning module having a compressor and indoor and outdoor heat exchangers, and an engine module having an engine combusting mixed gas and thus generating drive power for operating the compressor, the method including: measuring factors that are temperature and humidity of outside air, an rpm of the engine, intake pressure, and an air-fuel ratio, the factors having effects on driving of the engine in an operating environment where the engine is driven; measuring a necessary ignition voltage for an ignition coil in a manner that corresponds to at least one of a plurality of the measured factors; and calculating a dwell time at which the necessary ignition voltage is output by the ignition coil.

15 Claims, 4 Drawing Sheets

METHOD OF CONTROLLING GAS HEAT-PUMP SYSTEM

CROSS REFERENCE TO RELATED APPLICATION

The present application claims priority to Korean Patent Application No. 10-2019-0173203, filed Dec. 23, 2019, the entire contents of which is incorporated herein for all purposes by this reference.

BACKGROUND OF THE INVENTION

Field of the Invention

The present disclosure relates to a method of controlling a gas heat-pump system and, more particularly, to a method of controlling a gas heat-pump system capable of varying an ignition voltage for an ignition coil in an engine provided in the gas heat-pump system, according to an operating situation of the engine, and thus increasing output power of the engine and improving efficiency thereof.

Description of the Related Art

A heat-pump system is a system that is capable of performing a cooling or heating operation through a refrigeration cycle, and operates in cooperation with a hot water supply apparatus or a cooling and heating apparatus. That is, hot water is produced or air conditioning for cooling and heating is performed using a heat source that is obtained as a result of heat exchange occurring between refrigerant in a refrigeration cycle and a predetermined heat storage medium.

A configuration for the refrigeration cycle requires that a compressor compressing refrigerant, a condenser condensing the refrigerant compressed by the compressor, an expansion device decompressing the refrigerant condensed by the condenser, and an evaporator evaporating the decompressed refrigerant are included.

The heat-pump systems include a gas heat-pump system. High capacity compressors are required for industrial use or for air conditioning in large non-residential buildings. That is, the gas heat-pump system is used as a system that, instead of an electric motor, uses an electric motor to drive a compressor compressing a large amount of refrigerant into high-temperature, high-pressure gas.

Korean Patent No. 10-1341533 discloses a gas heat-pump system and a method of controlling the gas heat-pump system. The gas heat-pump system in the related art circulates compressor refrigerant using a gas engine for which a heat source is LNG, LPG, or the like for residential buildings and thus operates in a cooling mode in summer and in a heating mode in winter.

Combustion reaction is required to occur in a cylinder to drive the gas engine, and an air-fuel ratio, fuel injection timing, ignition timing, an ignition voltage, and the like need to be precisely matched with each other in order for the combustion reaction to occur. When these factors are not properly matched with each other, incomplete combustion occurs. In the worst case, an engine misfire situation where mixed gas is not combusted occurs.

When the engine misfire occurs, the engine does not operate at a constant rpm, and thus a surge phenomenon or the like occurs, thereby greatly decreasing the performance of the engine. Therefore, the engine needs to be driven in such a manner that the engine misfire does not occur.

In existing engines, an ignition voltage for an ignition coil is uniformly maintained. However, an operating environment where the engine is driven, when temperature of air is lowered or humidity is high, ignition does not occur well. Thus, the engine misfire occurs frequently.

The foregoing is intended merely to aid in the understanding of the background of the present disclosure, and is not intended to mean that the present disclosure falls within the purview of the related art that is already known to those skilled in the art.

SUMMARY OF THE INVENTION

An objective of the present disclosure is to provide a method of controlling a gas heat-pump system capable of varying an ignition voltage in a manner that corresponds to an external environment-associated factor and an engine operating condition-associated factor which have effects on driving of an engine in an operation environment where the engine is driven, and of preventing engine misfire from occurring.

According to an aspect of the present disclosure, there is provided a method of controlling a gas heat-pump system, the system including an air conditioning module having a compressor and indoor and outdoor heat exchangers, and an engine module having an engine combusting mixed gas and thus generating drive power for operating the compressor.

The method includes measuring factors that are temperature and humidity of outside air, an rpm of the engine, intake pressure, and an air-fuel ratio, the factors having effects on driving of the engine in an operating environment where the engine is driven; measuring a necessary ignition voltage for an ignition coil in a manner that corresponds to at least one of a plurality of the measured factors; and calculating a dwell time at which the necessary ignition voltage is output by the ignition coil.

In the method, the measuring of the factors may include: measuring the temperature of the outside air; measuring the humidity of the outside air; measuring the rpm of the engine; measuring the intake pressure using a pressure sensor provided in an intake manifold; and measuring the air-fuel ratio, which is a ratio of air weight to fuel weight, in a mixer mixing air and fuel.

In the method, in the calculating of the dwell time, a dwell adjustment time with respect to each of the factors may be selected in a manner that corresponds to a measurement value of each of the factors measured in the measuring of the factors, and the selected dwell adjustment time with respect to each of the factors may be added to a reference dwell time to calculate the dwell time.

In the method, in the calculating of the dwell time, the dwell time may be selected from a range of 1.0 to 3.0 ms, and when a sum of the selected dwell adjustment time with respect to each of the factors and the reference dwell time is 1.0 ms or less, the dwell time may be set to 1.0 ms, and when the sum thereof is 3.0 ms or more, the dwell time may be set to 3.0 ms.

In the method, in the calculating of the dwell time, when a value of the temperature measured in the measuring of the temperature falls within a temperature range of −20 to 50° C., a temperature-dependent dwell adjustment time may be selected from a range of −0.5 to 0.2 ms.

In the method, in the calculating of the dwell time, when the value of the temperature measured in the measuring of the temperature is −20° C. or less, the temperature-dependent dwell adjustment time may be set to 0.2 ms, and when the value of the temperature measured therein is 50° C. or more, the temperature-dependent dwell adjustment time may be set to −0.5 ms.

In the method, in the calculating of the dwell time, when a value of the humidity measured in the measuring of the humidity falls within a humidity range of 20 to 90%, a humidity-dependent dwell adjustment time may be selected from a range of 0 to 0.1 ms.

In the method, in the calculating of the dwell time, when the value of the humidity measured in the measuring of the humidity is 20% or less, the humidity-dependent dwell adjustment time may be set to 0 ms, and when the value of the humidity measured therein is 90% or more, the humidity-dependent dwell adjustment time may be set to 0.1 ms.

In the method, in the calculating of the dwell time, when a value of the rpm measured in the measuring of the rpm falls within a rpm range of 1000 to 2600 rpm, a rpm-dependent dwell adjustment time may be selected from a range of 0 to 0.5 ms.

In the method, in the calculating of the dwell time, when the value of the rpm measured in the measuring of the rpm is 1000 rpm or less, the rpm-dependent dwell adjustment time may be set to 0.5 ms, and when the value of the rpm measured therein is 2600 rpm or more, the temperature-dependent dwell adjustment time may be set to 0 ms.

In the method, in the calculating of the dwell time, when a value of the intake pressure measured in the measuring of the intake pressure falls within a pressure range of 400 to 1100 hPa, a pressure-dependent dwell adjustment time may be selected from a range of 0 to 0.3 ms.

In the method, in the calculating of the dwell time, when the value of the intake pressure measured in the measuring of the intake pressure is 400 hPa or less, the pressure-dependent dwell adjustment time may be set to 0.3 ms, and when the value of the intake pressure measured therein is 1100 hPa or more, the pressure-dependent dwell adjustment time may be set to 0 ms.

In the method, in the calculating of the dwell time, when a value of the air-fuel ratio measured in the measuring of the air-fuel ratio falls within an air-fuel ratio range of 0.9 to 1.5, an air-fuel ratio-dependent dwell adjustment time may be selected from a range of −0.5 to 0.7 ms.

In the method, in the calculating of the dwell time, when the value of the air-fuel ratio measured in the measuring of the air-fuel ratio is 0.9 or less, the air-fuel ratio-dependent dwell adjustment time may be set to −0.5 ms, and when the value of the air-fuel ratio measured therein is 1.5 or more, the air-fuel ratio-dependent dwell adjustment time may be set to 0.7 ms.

In the method of claim 3, wherein in the calculating of the dwell time, the reference dwell time may be set to 1.2 ms.

With the method of controlling the gas heat-pump system according to the present disclosure, the ignition voltage is caused to vary in a manner that corresponds to an external environment-associated factor and an engine operating condition-associated factor which have effects on the driving of the engine in an operation environment where the engine is driven. Thus, the advantage of preventing engine misfire from occurring can be achieved.

BRIEF DESCRIPTION OF THE DRAWINGS

The above and other objectives, features, and other advantages of the present disclosure will be more clearly understood from the following detailed description when taken in conjunction with the accompanying drawings, in which.

DETAILED DESCRIPTION OF THE INVENTION

Figure 1:
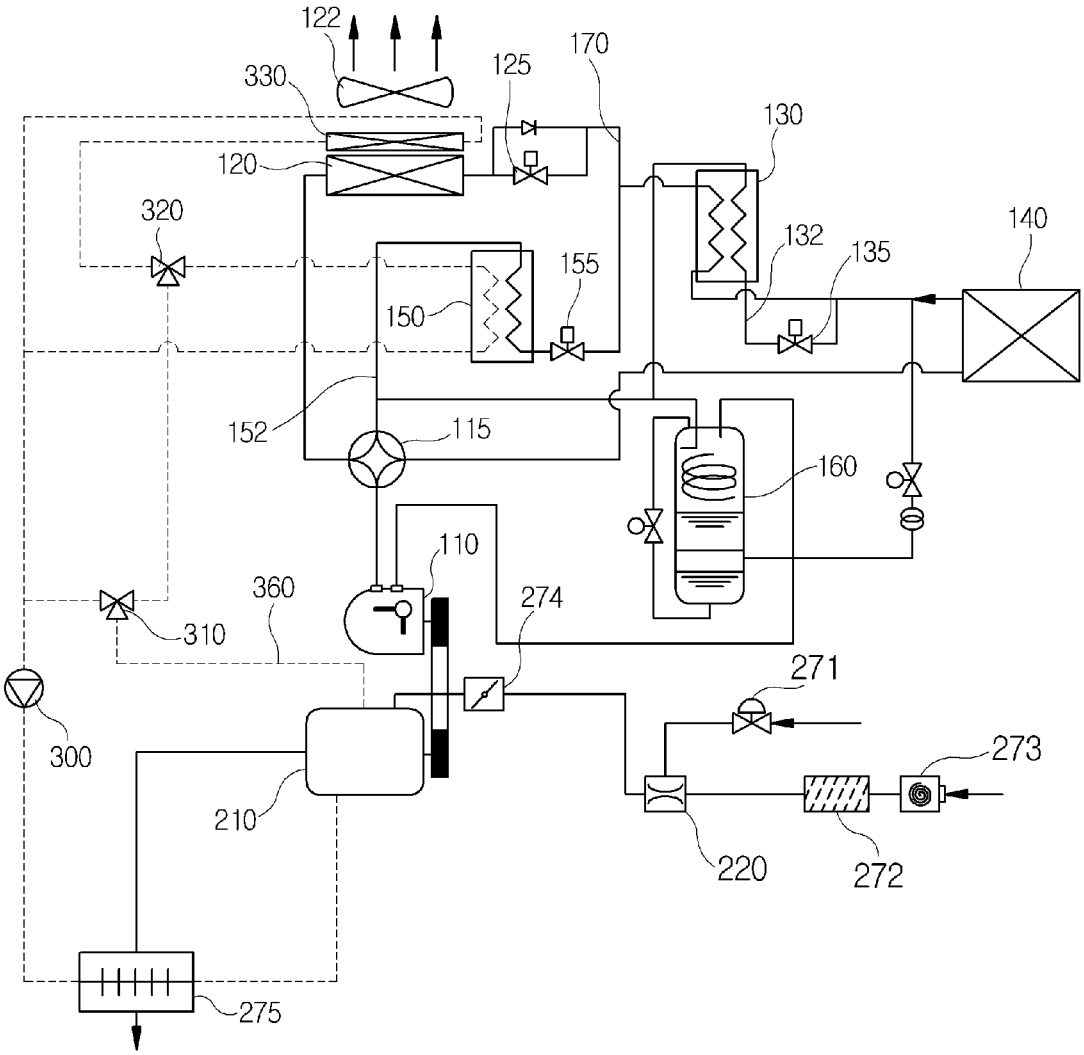
FIG. 1 is a view schematically illustrating a gas heat-pump system.

A method of controlling a gas heat-pump system according to an embodiment of the present disclosure will be described in more detail below to provide an understanding of features of the present disclosure.

It is noted that, if possible, the same constituent elements are given the same reference character throughout the accompanying drawings that are referred to for illustration and may be used as an aid in describing the embodiments. In addition, specific descriptions of well-known configurations and functions associated with the present disclosure will be omitted when determined as making the nature and gist of the present disclosure unclear.

Specific embodiments of the present disclosure will be described below with reference to the accompanying drawings.

FIG. 1 is a view schematically illustrating a gas heat-pump system.

With reference to FIG. 1, the gas heat-pump system includes an air conditioning module and the engine module.

The gas heat-pump system includes a plurality of components that constitute the air conditioning module for a refrigeration cycle.

As an example, the air conditioning module includes a compressor 110 and a four-way valve 115. The compressor 110 compresses a refrigerant. The four-way valve 115 switches a flow direction of the refrigerant compressed in the compressor 110.

The gas heat-pump system may further include an outdoor heat exchanger 120 and the indoor heat exchanger 140.

The outdoor heat exchanger 120 is arranged within an outdoor air conditioning condenser unit that is installed outdoors, and the indoor heat exchanger 140 is arranged within an indoor air conditioning condenser unit that is installed indoors. The refrigerant passing through the four-way valve 115 flows to the outdoor heat exchanger 120 or the indoor heat exchanger 140.

Components other than the indoor heat exchanger 140 and an indoor expansion device 145 of the gas heat-pump system, which are illustrated in FIG. 1, are arranged outdoors, that is, are arranged within the outdoor air conditioning condenser unit.

If the gas heat-pump system operates in a cooling operation mode, the refrigerant passing through the four-way valve 115 flows toward the indoor heat exchanger 140 through the outdoor heat exchanger 120.

In contrast, in a case where the gas heat-pump system operates in a heating operation mode, the refrigerant passing through the four-way valve 115 flows toward the outdoor heat exchanger 120 through the indoor heat exchanger 140.

The gas heat-pump system may further include a refrigerant pipe 170 (a flow path indicated by a solid line) that connects the compressor 110, the outdoor heat exchanger 120, the indoor heat exchanger 140, and the like to each other and guides a flow of the refrigerant.

First, a configuration of the gas heat-pump system operation in the cooling operation mode will be described below.

The refrigerant flowing to the outdoor heat exchanger 120 exchanges heat with outside air and thus is condensed. The outdoor fan 122 that blows the outside air into the outdoor heat exchanger 120 is arranged on one side thereof.

A main expansion device 125 for decompressing the refrigerant is provided to the exit side of the outdoor heat exchanger 120. For example, the main expansion device 125 includes an electronic expansion valve (EEV). When performing a cooling operation, the main expansion device 125 is fully open, and thus an operation of decompressing the refrigerant is not performed.

A supercooling heat changer 130 for additionally cooling the refrigerant is provided to the exit side of the main expansion device 125. A supercooling flow path 132 is connected to the supercooling heat changer 130. The supercooling flow path 132 branches off from the refrigerant pipe 170 and is connected to the supercooling heat changer 130.

The supercooling expansion device 135 is installed on |the supercooling flow path 132. The refrigerant passing along the supercooling flow path 132 is decompressed while passing through the supercooling expansion device 135.

In the supercooling heat changer 130, the heat exchange occurs between the refrigerant in the refrigerant pipe 170 and the refrigerant on the supercooling flow path 132. In a heat exchange process, the refrigerant in the refrigerant pipe 170 is supercooled, and the refrigerant on the supercooling flow path 132 absorbs heat.

The supercooling flow path 132 is connected to the gas-liquid separator 160. The refrigerant on the supercooling flow path 132, which exchanges heat in the supercooling heat changer 130, flows into the gas-liquid separator 160.

The refrigerant on the refrigerant pipe 170, which passes through the supercooling heat changer 130, flows toward the indoor air conditioning condenser unit, is decompressed in an indoor expansion device 145, and then evaporates in the indoor heat exchanger 140. The indoor expansion device 145 is installed within the indoor air conditioning condenser unit and is configured as the electronic expansion valve (EEV).

In addition, the refrigerant evaporating in the indoor heat exchanger 140 passes through the four-way valve 115 and then may flow right into the gas-liquid separator 160. Gaseous refrigerant resulting from refrigerant separation is absorbed into the compressor 110.

In the gas heat-pump system, the engine module includes an engine 210 and various components for supplying mixed gas to the engine 210.

The gas heat-pump system may further include a mixer 220 that is arranged to the entrance side of the engine 210 and supplies the mixed fuel.

The gas heat-pump system may further include an air filter 272, a silencer 273, and a zero governor 271. The air filter 272 supplies purified air to the mixer 220. The silencer 273 reduces intake noise. The zero governor 271 supplies fuel at predetermined pressure or lower. The zero governor 271 is a device that, regardless of a magnitude of entrance pressure of the fuel or a change in an amount of flow, adjusts exit pressure thereof uniformly and supplies the resulting exit pressure.

The air passing through the air filter 272 and the fuel discharged from the zero governor 271 are mixed in the mixer 220 and constitute the mixed gas. The mixed gas is supplied to the engine 210.

The gas heat-pump system may further include a flow control unit 274 that is arranged between the mixer 220 and the engine 210.

The flow control unit 274 controls an amount of the mixed gas to be supplied to the engine 210. As an example, the flow control unit 274 is provided as a valve that employs an electronic throttle control (ETC) scheme. Thus, the amount of the mixed gas to be supplied to the engine 210 through the flow control unit 274 is precisely controlled.

The gas heat-pump system may further include an exhaust gas heat exchanger 280 which is arranged to the exhaust outlet side of the engine 210 and in which the heat exchange occurs between coolant and exhaust gas.

The gas heat-pump system may further include a coolant pipe 360 (a flow path indicated by a dotted line that guides a flow of the coolant for cooling the engine 210.

A coolant pump 300, a plurality of flow control valves 310 and 320, and a radiator 330 are installed on the coolant pipe 360. The coolant pump 300 generates a force for causing coolant flow. The plurality of flow control valves 310 and 320 switch a flow direction of the coolant. The radiator 330 cools the coolant.

The flow control valves 310 and 320 include a first flow control valve 310 and a second flow control valve 320. As an example, the first flow control valve 310 and the second flow control valve 320 each have a three-way valve.

The radiator 330 is positioned to one side of the outdoor heat exchanger 120. The coolant in the radiator 330 exchanged heat with the outside air by driving the outdoor fan 122 and, during this heat exchange, is cooled.

When the coolant pump 300 is driven, the coolant passes through the engine 210 and the exhaust gas heat exchanger 280 and selectively flows into the radiator 330 or an auxiliary heat exchanger 150 through the first flow control valve 310 and the second flow control valve 320.

Figure 2:
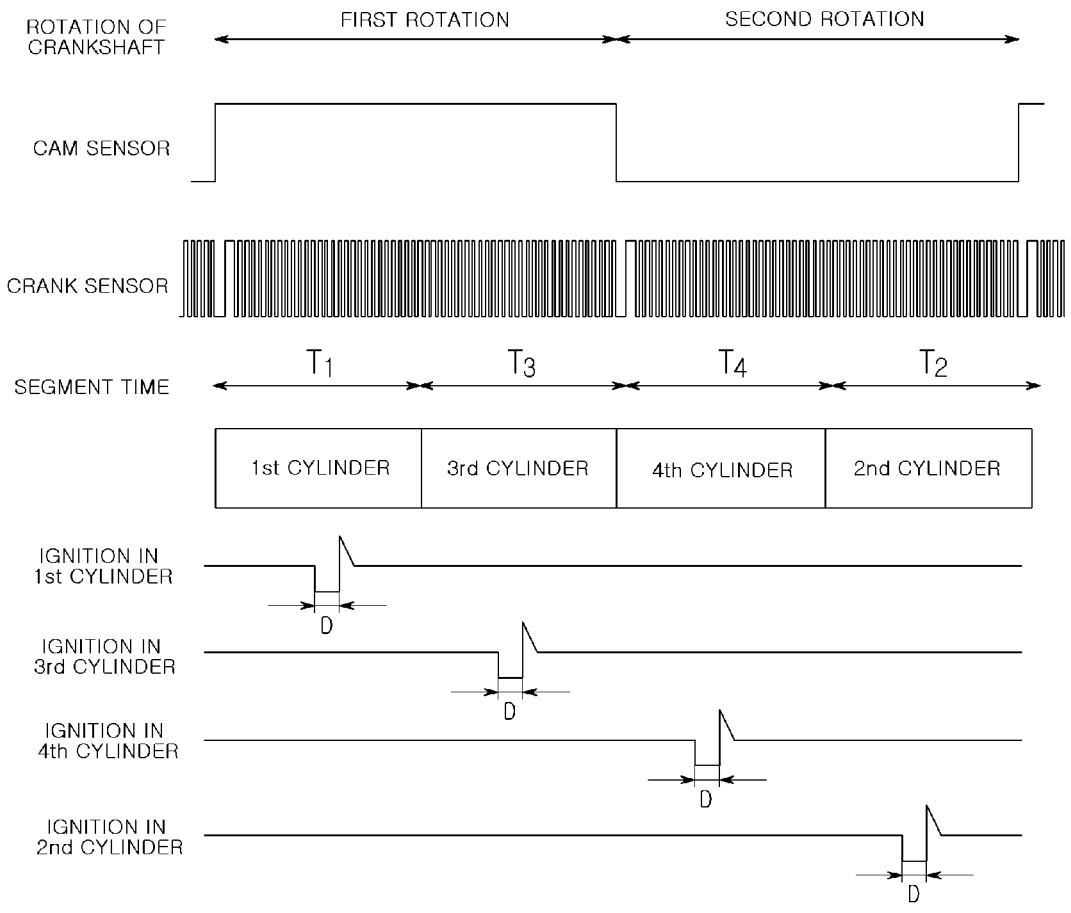
FIG. 2 is a view schematically illustrating operations of respective cylinders in a manner that corresponds to control signals to describe a method of controlling the gas heat-pump system according to the present disclosure.

FIG. 2 is a view schematically illustrating operations of respective cylinders in a manner that corresponds to control signals to describe a method of controlling the gas heat-pump system according to the present disclosure.

With reference to FIG. 2, an engine of the gas heat-pump system will be described below, taking as an example a four-stroke cycle engine having four cylinders.

The engine includes a cam sensor and a crank sensor. The cam sensor finds the top dead center of a piston in one of a plurality of cylinders. The crank sensor measures a rotational angle of a crankshaft.

The cam sensor is provided to find the top dead center of a piston in a first cylinder.

The crank sensor is provided as a Hall sensor. The crank sensor recognizes a plurality of protrusions that protrude along a circumferential direction from the crankshaft, and thus measures the rotational angle of the crankshaft.

Data measurement technologies that use the cam sensor and the crank sensor generally apply to engines in the related art, and thus detailed descriptions thereof are omitted.

Driving of the engine is described in more detail with reference to FIG. 2. Firstly, the mixed gas is ignited by an ignition coil provided in the first cylinder, and thus the crankshaft is rotated by 0 to 180 degrees. Secondly, the mixed gas is ignited by an ignition coil provided in a third cylinder, and thus the crankshaft is rotated by 180 to 360 degrees. Thirdly, the mixed gas is ignited by an ignition coil provided in a fourth cylinder, and thus the crankshaft is rotated by 360 to 540 degrees. Lastly, the mixed gas is ignited by an ignition coil provided in a second cylinder, and thus the crankshaft is rotated by 540 to 720 degrees. That is, the mixed gas is ignited by the ignition coils provided in the first cylinder, the third cylinder, the fourth cylinder, and the second cylinder in this order, and thus the crankshaft is rotated once, thereby driving the engine.

When the ignition coil ignites the mixed gas, an ignition voltage is proportional to a dwell time D for the ignition coil. As an example, when the ignition voltage is set to 25 kV, the dwell time D is 1.0 ms, and when the ignition voltage is set to 55 kV, the dwell time D is 3.0 ms.

Figure 3:
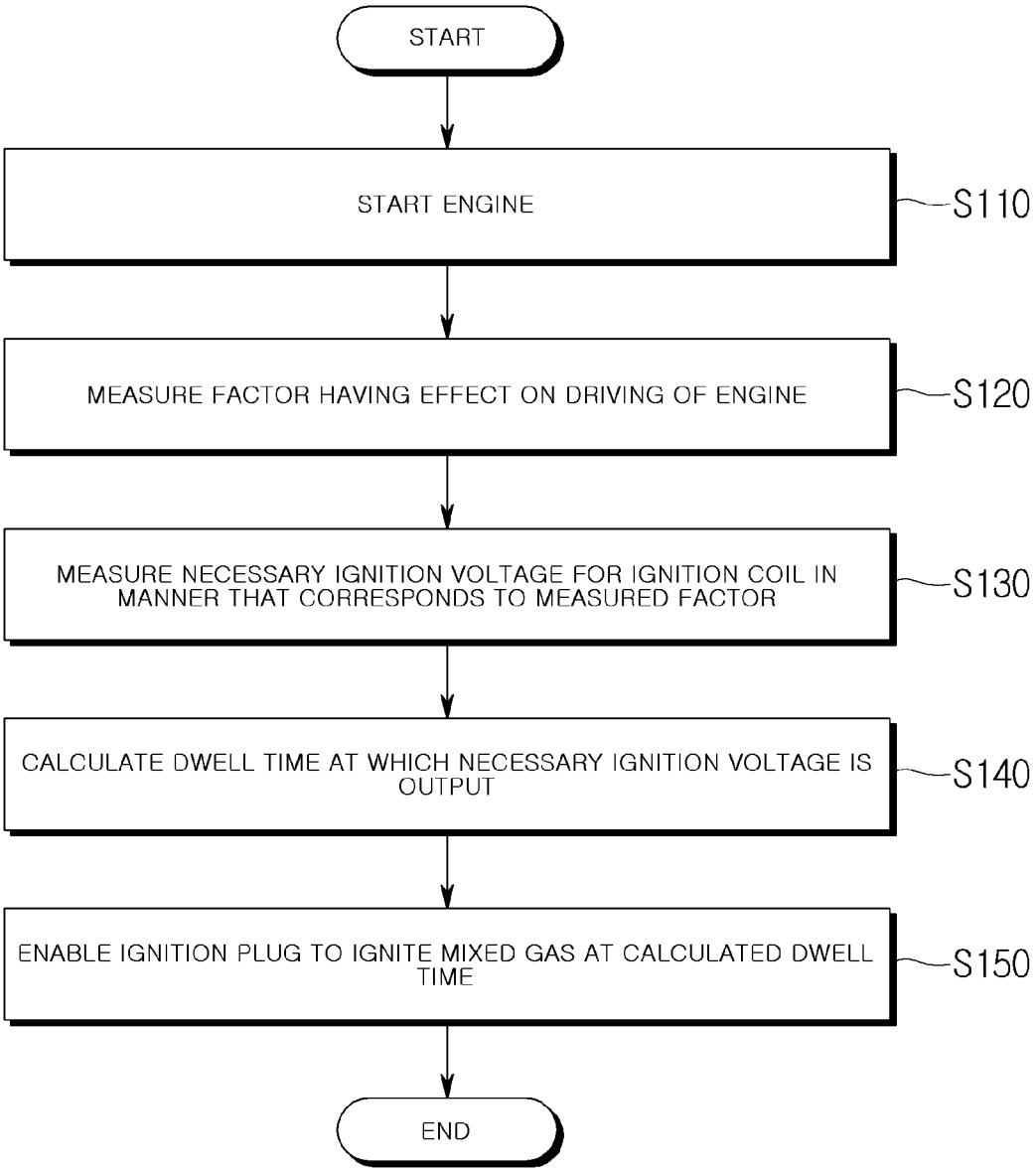
FIG. 3 is a flowchart schematically illustrating the method of controlling the gas heat-pump system according to the embodiment of the present disclosure.
Figure 4:
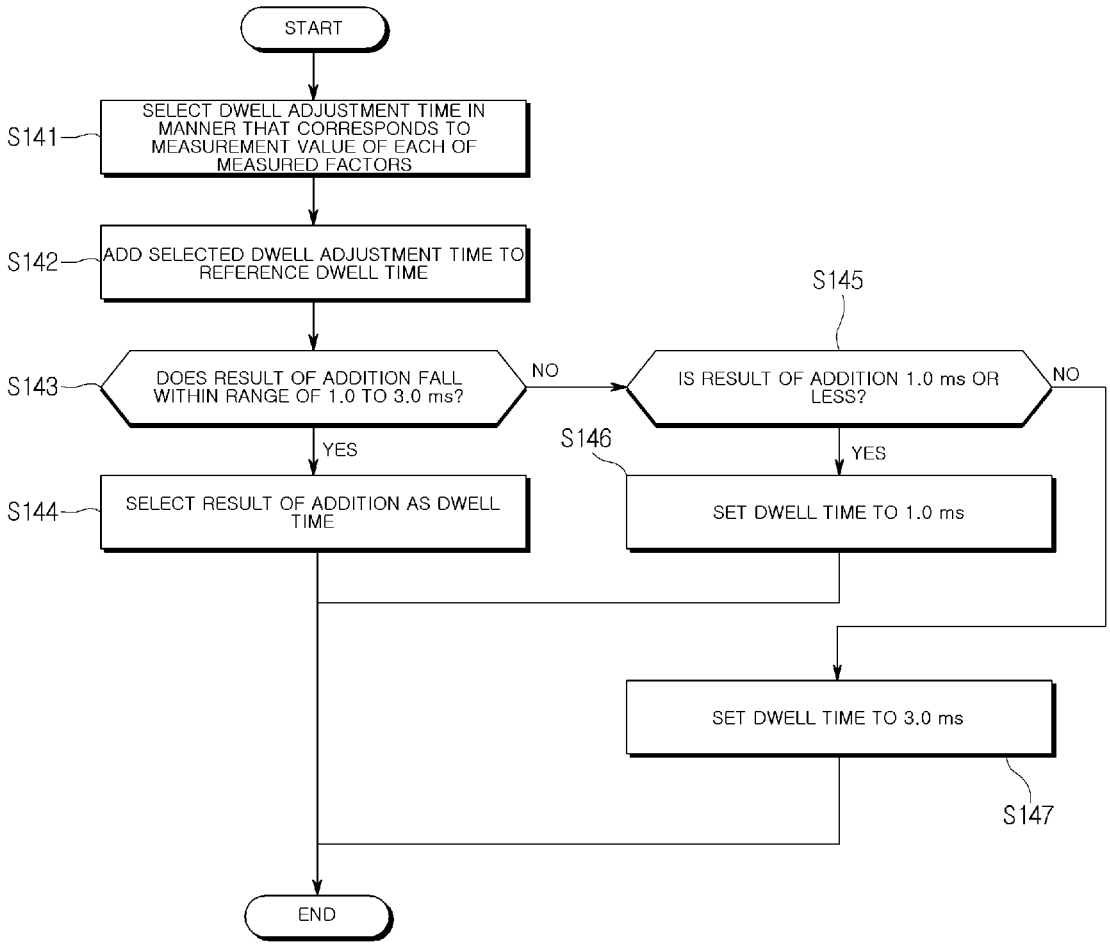
FIG. 4 is a flowchart schematically illustrating steps of calculating a dwell time in the method of controlling the gas heat-pump system according to the present disclosure.

FIG. 3 is a flowchart schematically illustrating the method of controlling the gas heat-pump system according to the embodiment of the present disclosure. FIG. 4 is a flowchart schematically illustrating steps of calculating the dwell time in the method of controlling the gas heat-pump system.

With reference to FIGS. 3 and 4, the method of controlling the gas heat-pump system according to the embodiment of the present disclosure includes an engine starting step S110, a factor measurement step S120, an ignition voltage measurement step S130, a dwell time calculation step S140, and an ignition-coil ignition step S150. In the engine starting step S110, the engine is first started. In the factor measurement step S120, a factor having an effect on the driving of the engine is measured. In the ignition voltage measurement step S130, a necessary ignition voltage for the ignition coil is measured in a manner that corresponds to the measured factor. In the dwell time calculation step S140, the dwell time at which the necessary ignition voltage is output is calculated. In the ignition-coil ignition step S150, the mixed gas is ignited by the ignition coils at the calculated dwell time.

That is, with the method of controlling the gas heat-pump system according to the present disclosure, when starting the engine, factors resulting from an external environment where the engine is driven, which have effects on the ignition by the ignition coil, and factors resulting from a condition for driving the engine, which have effects on the ignition by the ignition coil are selected, and the selected factors are measured. Then, an optimal necessary ignition voltage for the ignition coil is measured in a manner that corresponds to the measured factor, and the dwell time at which the optimal necessary ignition voltage is output is calculated. Then, the mixed gas is ignited by the ignition coil at the optimal necessary ignition voltage, and thus the engine is driven without causing engine misfire to occur.

In the factor measurement step S120, in an operating environment where the engine is driven, factors, such as temperature and humidity of outside air, an rpm of the engine, intake pressure, and an air-fuel ratio, which have effects on the driving of the engine, are measured.

The factor measurement step S120 includes a temperature measurement sub-step, a humidity measurement sub-step, a rpm measurement sub-step, an intake pressure measurement sub-step, and an air-fuel ratio measurement sub-step. In the temperature measurement sub-step, the temperature of the outside air is measured. In the humidity measurement sub-step, the humidity of the outside air is measured. In the rpm measurement sub-step, the rpm of the engine is measured. In the intake pressure measurement sub-step, intake pressure is sensed by a pressure sensor provided in an intake manifold. In the air-fuel ratio measurement sub-step, the air-fuel ratio that is a ratio of air weight to fuel weight is measured in the mixer 220 that mixes fuel and air.

In the operating environment where the engine is driven, the temperature of the outside air has an effect on temperature of the mixed gas to be supplied to a combustion chamber of the engine. The higher the temperature of the mixed gas to be supplied to the combustion chamber, the more easily elections that constitute an air molecule become free electrons. Accordingly, the mixed gas becomes ionized, and thus ignition occurs easily.

Therefore, when the temperature of the outside air is high, it is easy for the ignition to occur, and thus a low ignition voltage is required. Conversely, when the temperature of the outside air is low, it is relatively difficult for the ignition to occur, and thus a high ignition voltage is required.

In the operating environment where the engine is driven, the humidity of the outside air has an effect on specific heat of, and an oxygen concentration in, the mixed gas to be supplied to the combustion chamber of the engine. When the humidity of the outside air is high, the specific heat of the mixed gas to be supplied to the combustion chamber increases, and the oxygen concentration decreases. Thus, the mixed gas, when combusted, decreases in temperature. For this reason, incomplete combustion occurs.

Therefore, when the humidity of the outside air is high, the temperature of the mixed gas is low on ignition, and thus a high ignition voltage is required. Conversely, when the humidity of the outside air is low, the temperature of the mixed gas is relatively high on ignition, and thus a low ignition voltage is required.

In the operating environment where the engine is driven, when the engine operates in a condition where the rpm of the engine and the intake pressure are high, temperature of an electrode of an ignition plug is kept high, and thus molecules that constitute the electrode move actively. Vibration of the molecules causes electrons around an atomic nucleus to move to an outer shell on a surface of the electrode and to become free electrons. Thus, it is easy for the ignition to occur.

Therefore, when the rpm of the engine and the intake pressure are high, it is easy for the ignition to occur, and thus a low ignition voltage is required. Conversely, when the rpm of the engine and the intake pressure are low, it is relatively difficult for the ignition to occur, and thus a high ignition voltage is required.

In the operating environment where the engine is driven, when the air-fuel ratio of the mixed gas is high, that is, when the air weight increases with respect to the fuel weight at the ratio of the air weight to the fuel weight, insulation resistance increases, and thus the ignition does not occur well.

Therefore, when the air-fuel ratio is low, the insulation resistance is low. Accordingly, it is easy for the ignition to occur, and thus a low ignition voltage is required. Conversely, the air-fuel ratio is high, the insulation resistance is high. Accordingly, the ignition does not occur relatively well, and thus a high ignition voltage is required.

In the ignition voltage measurement step S130, a necessary ignition voltage for the ignition coil is measured in a manner that corresponds to at least one of a plurality of the measured factors.

The factors, such as the temperature and humidity of the outside air, the rpm of the engine, the intake pressure, and the air-fuel ratio, which are measured in the factor measurement step S120 correspond to factors for adjusting the ignition voltage for the ignition coil. That is, when the temperature of the outside air is low, the humidity thereof is high, the rpm of the engine and the intake pressure are low, and the air-fuel ratio is high, the ignition voltage for the ignition coil are set to be high, and thus the engine misfire can be prevented from occurring.

The ignition voltage here is proportional to the dwell time for the ignition coil. That is, when the dwell time is lengthened, the ignition voltage increases, and when the dwell time is shortened, the ignition voltage decreases.

Therefore, when a necessary ignition voltage is selected in a manner that corresponds to a change in each of the factors, the dwell time for the ignition coil is correspondingly adjusted, and thus the necessary ignition voltage is output.

In the dwell time calculation step S140, the dwell time at which the necessary ignition voltage is output from the ignition coil is calculated.

More specifically, in the dwell time calculation step S140, a dwell adjustment time with respect to each of the factors is selected in a manner that corresponds to a measurement value of each of the factors measured in the factor measurement step S120, and the selected dwell adjustment time with respect to each of the factors is added to a reference dwell time to calculate the dwell time.

A method of selecting the dwell adjustment time corresponding to the measurement value of each of the factors is preset through a plurality of experiments.

As an example, the temperature of the outside air at which the engine is driven is set to vary at intervals of 10° C. The dwell adjustment time at each temperature is added to the reference dwell time until the dwell time is found. In this manner, an optimal ignition voltage is selected. The dwell adjustment time adjusted to output the selected ignition voltage is calculated, and the temperature of the outside air and the calculated dwell adjustment time are matched with each other. A database is generated in such a manner as to contain records these matching results in fields. For example, the database is generated in such a manner that, when the temperature of the outside air is −10° C., the dwell time is obtained by adding 0.1 ms to the reference dwell time, and that, when the temperature of the outside air is −20° C., the dwell time is obtained by subtracting 0.2 ms from the reference dwell time.

In this manner, in the database, a value of the dwell adjustment time with respect to each of the temperature and humidity of the outside air, the rpm of the engine, the intake pressure, and the air-fuel ratio corresponds to a change in the measurement value of each of the temperature and humidity of the outside air, the rpm of the engine, the intake pressure, and the air-fuel ratio.

In the dwell time calculation step S140, a minimum dwell time and a maximum dwell time for the ignition are limited. As an example, if the dwell adjustment time with respect to each of the factors is selected in a manner that corresponds to the measurement value of each of the measured factors (S141), when a result of adding the selected dwell adjustment time with respect to each of the factors to the reference dwell time (S142) falls within a range of 1.0 to 3.0 ms (YES in S143), the result of the addition is selected as the dwell time (S144). When the sum of the selected dwell adjustment time with respect to each of the factors and the reference dwell time is 1.0 ms or less (YES in S145), the dwell time is set to 1.0 ms (S146). When the sum thereof is 3.0 ms or more (NO in S145), the dwell time is set to 3.0 ms (S147). That is, the minimum dwell time and the maximum dwell time are limited to 1.0 ms and 3.0 ms, respectively.

As an example, a value range where the dwell adjustment time is set according to the change in each of the factors is selected as follows.

If a value of the temperature measured in the temperature measurement sub-step falls within a temperature range of −20 to 50° C., a temperature-dependent dwell adjustment time is selected from a range of −0.5 to 0.2 ms. When the value of the temperature measured in the temperature measurement sub-step is −20° C. or less, the temperature-dependent dwell adjustment time is set to 0.2 ms. When the value of the temperature measured therein is 50° C. or more, the temperature-dependent dwell adjustment time is set to −0.5 ms. In this manner, the minimum and maximum ignition voltage are limited.

When a value of the humidity measured in the humidity measurement sub-step falls within a humidity range of 20 to 90%, a humidity-dependent dwell adjustment time is selected from a range of 0 to 0.1 ms. When the value of the humidity measured in the humidity measurement sub-step is 20% or less, the humidity-dependent dwell adjustment time is set to 0 ms. When the value of the humidity measured therein is 90% or more, the humidity-dependent dwell adjustment time is set to 0.1 ms. In this manner, the minimum and maximum ignition voltage are limited.

When a value of the rpm measured in the rpm measurement sub-step falls within a rpm range of 1000 to 2600 rpm, a rpm-dependent dwell adjustment time is selected from a range of 0 to 0.5 ms. When the value of the rpm measured in the rpm measurement sub-step is 1000 rpm or less, the rpm-dependent dwell adjustment time is set to 0.5 ms. When the value of the rpm measured therein is 2600 rpm or more, the temperature-dependent dwell adjustment time is set to 0 ms. In the manner, the minimum and maximum ignition voltages are limited.

When a value of the intake pressure measured in the intake pressure measurement sub-step falls within a pressure range of 400 to 1100 hPa, a pressure-dependent dwell adjustment time is selected from a range of 0 to 0.3 ms. When the value of the intake pressure measured in the intake pressure measurement sub-step is 400 hPa or less, a pressure-dependent dwell adjustment time is set to 0.3 ms. When the value of the intake pressure measured therein is 1100 hPa or more, the pressure-dependent dwell adjustment time is set to 0 ms. In this manner, the minimum and maximum ignition voltages are limited.

When a value of the air-fuel ratio measured in the air-fuel ratio measurement sub-step falls within an air-fuel range of 0.9 to 1.5, an air-fuel ratio-dependent dwell adjustment time is selected from a range of −0.5 to 0.7 ms. The value of the air-fuel measured in the air-fuel ratio measurement sub-step is 0.9 or less, the air-fuel ratio-dependent dwell adjustment time is set to −0.5 ms. When the value of the air-fuel measured therein is 1.5 ms or more, the air-fuel ratio-dependent dwell adjustment time is set to 0.7 ms. In this manner, the minimum and maximum ignition voltages are limited.

As an example, when the operating environment where the engine for which the reference dwell time for the ignition coil is set to 1.2 ms is driven is that the temperature of the outside air, the humidity of the outside air, the rpm of the engine, the intake pressure, and the air-fuel ratio are 20° C., 30%, 1800 rpm, 700 hPa, and 1.1, respectively, the temperature-dependent dwell adjustment time, the humidity-dependent dwell adjustment time, the rpm-dependent dwell adjustment time, the pressure-dependent dwell adjustment time, and the air-fuel ratio-dependent dwell adjustment time are −0.2 ms, 0.02 ms, 0.24 ms, 0.18 ms, and 0.2 ms, respectively.

Therefore, the dwell time in the operating environment where the engine is driven and in an operating condition where the engine is driven is 1.64 ms that is the dwell time obtained by adding each dwell adjustment time to the reference dwell time. Thus, the dwell time for the ignition coil is changed to 1.64 ms, and then the mixed gas is ignited by the ignition plug.

With the method of controlling the gas heat-pump system according to the embodiment of the present disclosure, in the operating environment where the engine is driven, the ignition voltage is caused to vary in real time in a manner that corresponds to the temperature and humidity of the outside air that are external environment-associated factors having effects on the driving of the engine and in a manner that corresponds to the rpm of the engine, the intake pressure, and the air-fuel ratio that are engine operating condition-associated factors having effects on the driving of the engine. Thus, the advantage of preventing the engine misfire from occurring can be achieved.

Although the specific embodiment of the present disclosure has been described for illustrative purposes, those skilled in the art will appreciate that various modifications, additions and substitutions are possible, without departing from the scope and spirit of the disclosure as disclosed in the accompanying claims.

What is claimed is:

1. A method of controlling a gas heat-pump system, the system comprising an air conditioning module having a compressor and indoor and outdoor heat exchangers, and an engine module having an engine combusting mixed gas and thus generating drive power for operating the compressor, the method comprising:

measuring factors that are temperature and humidity of outside air, an rpm of the engine, intake pressure, and an air-fuel ratio, the factors having effects on driving of the engine in an operating environment where the engine is driven;

measuring a necessary ignition voltage for an ignition coil in a manner that corresponds to at least one of a plurality of the measured factors; and calculating a dwell time at which the necessary ignition voltage is output by the ignition coil.

2. The method of claim 1, wherein the measuring of the factors comprises:

measuring the temperature of the outside air;

measuring the humidity of the outside air;

measuring the rpm of the engine;

measuring the intake pressure using a pressure sensor provided in an intake manifold; and measuring the air-fuel ratio, which is a ratio of air weight to fuel weight, in a mixer mixing air and fuel.

3. The method of claim 2, wherein in the calculating of the dwell time, a dwell adjustment time with respect to each of the factors is selected in a manner that corresponds to a measurement value of each of the factors measured in the measuring of the factors, and the selected dwell adjustment time with respect to each of the factors is added to a reference dwell time to calculate the dwell time.

4. The method of claim 3, wherein in the calculating of the dwell time, the dwell time is selected from a range of 1.0 to 3.0 ms, and when a sum of the selected dwell adjustment time with respect to each of the factors and the reference dwell time is 1.0 ms or less, the dwell time is set to 1.0 ms, and when the sum thereof is 3.0 ms or more, the dwell time is set to 3.0 ms.

5. The method of claim 4, wherein in the calculating of the dwell time, when a value of the temperature measured in the measuring of the temperature falls within a temperature range of −20 to 50° C., a temperature-dependent dwell adjustment time is selected from a range of −0.5 to 0.2 ms.

6. The method of claim 5, wherein in the calculating of the dwell time, when the value of the temperature measured in the measuring of the temperature is −20° C. or less, the temperature-dependent dwell adjustment time is set to 0.2 ms, and when the value of the temperature measured therein is 50° C. or more, the temperature-dependent dwell adjustment time is set to −0.5 ms.

7. The method of claim 4, wherein in the calculating of the dwell time, when a value of the humidity measured in the measuring of the humidity falls within a humidity range of 20 to 90%, a humidity-dependent dwell adjustment time is selected from a range of 0 to 0.1 ms.

8. The method of claim 7, wherein in the calculating of the dwell time, when the value of the humidity measured in the measuring of the humidity is 20% or less, the humidity-dependent dwell adjustment time is set to 0 ms, and when the value of the humidity measured therein is 90% or more, the humidity-dependent dwell adjustment time is set to 0.1 ms.

9. The method of claim 4, wherein in the calculating of the dwell time, when a value of the rpm measured in the measuring of the rpm falls within a rpm range of 1000 to 2600 rpm, a rpm-dependent dwell adjustment time is selected from a range of 0 to 0.5 ms.

10. The method of claim 9, wherein in the calculating of the dwell time, when the value of the rpm measured in the measuring of the rpm is 1000 rpm or less, the rpm-dependent dwell adjustment time is set to 0.5 ms, and when the value of the rpm measured therein is 2600 rpm or more, the temperature-dependent dwell adjustment time is set to 0 ms.

11. The method of claim 4, wherein in the calculating of the dwell time, when a value of the intake pressure measured in the measuring of the intake pressure falls within a pressure range of 400 to 1100 hPa, a pressure-dependent dwell adjustment time is selected from a range of 0 to 0.3 ms.

12. The method of claim 11, wherein in the calculating of the dwell time, when the value of the intake pressure measured in the measuring of the intake pressure is 400 hPa or less, the pressure-dependent dwell adjustment time is set to 0.3 ms, and when the value of the intake pressure measured therein is 1100 hPa or more, the pressure-dependent dwell adjustment time is set to 0 ms.

13. The method of claim 4, wherein in the calculating of the dwell time, when a value of the air-fuel ratio measured in the measuring of the air-fuel ratio falls within an air-fuel ratio range of 0.9 to 1.5, an air-fuel ratio-dependent dwell adjustment time is selected from a range of −0.5 to 0.7 ms.

14. The method of claim 13, wherein in the calculating of the dwell time, when the value of the air-fuel ratio measured in the measuring of the air-fuel ratio is 0.9 or less, the air-fuel ratio-dependent dwell adjustment time is set to −0.5 ms, and when the value of the air-fuel ratio measured therein is 1.5 or more, the air-fuel ratio-dependent dwell adjustment time is set to 0.7 ms.

15. The method of claim 3, wherein in the calculating of the dwell time, the reference dwell time is set to 1.2 ms.

* * * * *